United States Patent [19]

Berglund et al.

[11] 4,386,261

[45] May 31, 1983

[54] APPARATUS FOR HEATING BREATHING GAS FOR DIVERS

[75] Inventors: Nils O. H. Berglund, Älvsjö; Per A. Olsson, Nyköping, both of Sweden

[73] Assignee: Studsvik Energiteknik AB, Nyköping, Sweden

[21] Appl. No.: 227,042

[22] PCT Filed: May 14, 1980

[86] PCT No.: PCT/SE80/00143

§ 371 Date: Dec. 23, 1980

§ 102(e) Date: Dec. 23, 1980

[87] PCT Pub. No.: WO80/02541

PCT Pub. Date: Nov. 27, 1980

[30] Foreign Application Priority Data

May 18, 1979 [SE] Sweden ..... 7904392

[51] Int. Cl.[3] ..... B63C 11/18; B63C 11/28; H05B 3/40

[52] U.S. Cl. ..... 219/374; 219/378; 128/204.17

[58] Field of Search ..... 128/204.17; 219/374, 219/378, 375, 381

[56] References Cited

U.S. PATENT DOCUMENTS

| | | | |
|---|---|---|---|
| 2,515,835 | 7/1950 | Preston | 219/378 X |
| 3,107,669 | 10/1963 | Gross | 128/204.17 |
| 3,270,182 | 8/1966 | Hynes | 219/374 X |
| 3,336,464 | 8/1967 | Hittenberger et al. | 219/374 |
| 3,770,938 | 11/1973 | Agarate | 219/374 |
| 3,898,978 | 8/1975 | Marcus | 128/204.17 X |
| 3,924,619 | 12/1975 | Banjavich | 128/204.17 |

*Primary Examiner*—Roy N. Envall, Jr.

*Attorney, Agent, or Firm*—Burns, Doane, Swecker & Mathis

[57] ABSTRACT

A gas heating apparatus for divers comprises an electrical heating cartridge (1) which is replacably inserted with close fit into a gilled pipe (2) having an external helical flange (3). The pipe (2) is surrounded by a mantle (4) which is connected to a hood (8) with an outlet nozzle (9). The hood (8) and the pipe (2) is with a substantial play inserted into a pressure vessel (5,6,10). The vessel has an end cap (6) through which the hood nozzle (9) extends. The end cap (6) has also an inlet nozzle (7) for cold gas, which thus can flow through the gap (12) between the mantle (4) and the vessel wall (5) to the pipe end opposite the hood (8), and from there the gas flows in a helical path through a channel section defined by the flange (3) and the mantle (4) to the outlet nozzle (9) and is heated during passage along said path. The vessel also comprises an openable sealable compartment (19), wherein an electrical connection between the cartridge (1) and a power supply cable can be sealed from the ambient water.

4 Claims, 1 Drawing Figure

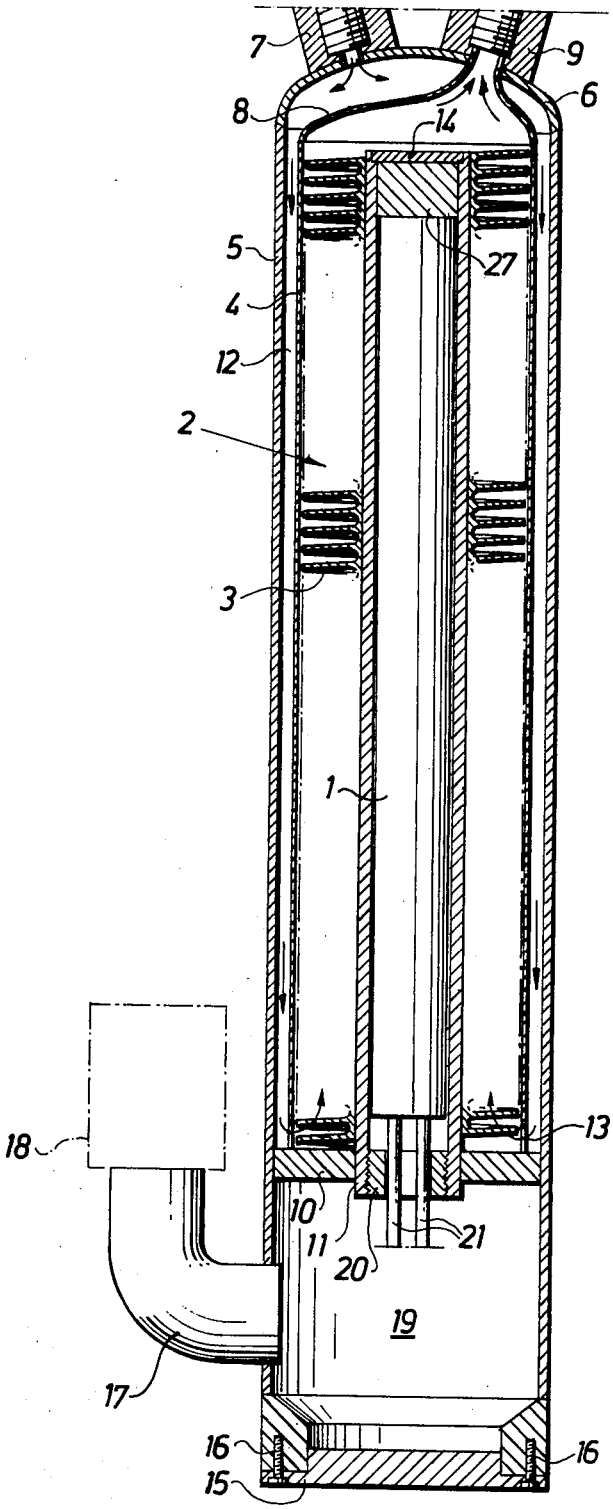
7
9
6
8
14
5
27
4
12
2
3
1
18
13
10
11
20
21
19
17
16
16
15

APPARATUS FOR HEATING BREATHING GAS FOR DIVERS

TECHNICAL FIELD

The invention refers to an apparatus for heating breathing gas for divers, comprising an electric heating element which is arranged to transfer heat to the breathing gas in a gas channel in a breathing gas equipment adapted to be carried by the diver, by heat transfer through the wall of the gas channel.

BACKGROUND

An apparatus for heating breathing gas for divers, comprising an electric heating source which is arranged to transfer heat to breathing gas in a gas line in a diving equipment supported by divers, is previously known from U.S. Pat. No. 3,107,669. Such a known heating apparatus is intended directly or indirectly to supply the diver with heat energy in the purpose of reducing the diver's heat losses, especially at jobs in cold waters. Normally the diver wears a heat insulating diving dress which reduces heat losses to the surrounding cold water. The diver is cooled down or chilled partly by heat losses via the diving dress to the ambient cold water, partly by losing body heat via the lungs to the cold breathing gas. By heating the breathing gas, primarily heat losses to the breathing gas are reduced, and at further increase of the breathing gas temperature heat can be supplied to the diver's body via the lungs and the blood system, and this heat will partly compensate for the heat loss from the body to the ambient water. The requirement of supplied heat energy varies depending on how well the dress isolates, and how large the diver's own heat production is due to the word performed.

The apparatus revealed in U.S. Pat. No. 3,107,669, however, has not proved to be suitable for practical use. At diving jobs, especially at relatively large depths, a breathing gas is often utilized, the composition of which deviates from the composition of atmospheric air, for example thereby that the nitrogen largely has been substituted by noble gases, and thereby that the oxygen content is increased. Furthermore, it is required that the heating apparatus be able to supply relatively high heat flow to the breathing gas, and in this connection a heating effect of for example 200 W may be suitable. The U.S. patent teaches that an electrically heat wire shall be fitted exposed to the gas in the mouthpiece of the equipment, which is also provided with inlet and outlet valves for the gas. If the heating wire or element should have such a surface area that the required heat effect could be transferred to the breathing gas flow without any risk for momentary unpermissible super heatings of the breathing gas, the surface area volume requirement and weight of the heating element would be relatively large, which in turn means that the mouthpiece would be uncomfortable to carry, and furthermore, the mouthpiece would hamper the field of sight, and, therefore, such a mouthpiece would not be useful at demanding tasks. Moreover, the heating element is located close to the diver's face, and it is appreciated that an electrical malfunction in the heating element easily could bring about that electricity is conducted to the diver as the breathing out gas is moist.

Moreover, there are boiling systems known for transforming liquid oxygen into gaseous state whereby to put the oxygen in a form suitable for breathing purposes. At such apparatus (vide for example U.S. Pat. No. 2,515,835) simple heat exchangers are utilized, and the known systems of this sort do not provide any technique useful in connection with diving works performed in cold water.

OBJECT OF THE INVENTION

An object of the invention is to provide an apparatus for heating breathing gas for divers, which is useful in practice, and which is sturdy, reliable and efficient. Another object is to provide an apparatus of said type which is easy to maintain. Other objects will be obvious to the artsmen from the following specification.

DISCLOSURE OF THE INVENTION

The invention refers to an apparatus for heating breathing gas for divers, comprising an electrical heating element which is arranged to transfer heat to the breathing gas in a gas channel in a breathing gas equipment adapted to be carried by the diver, by heat transfer through the wall of the gas channel, and is distinguished thereby that the apparatus comprises a pressure vessel, which by means of a partition is divided into a first gas tight chamber in which the gas channel is located, the channel surrounding the element, and a second chamber which is openable and arranged to house connection equipment for connecting a feeding cable, which extends from a current source located above the water surface, to the heating element, said gas channel comprising two coaxial sections of which the first section is defined by the inner wall of the pressure vessel and a mantle coaxial to said wall, and the other section thereof being defined by the mantle and an envelope surrounding the element, the breathing gas being arranged to flow in the axial direction along at least part of the first (heat insulating) section, and then to flow in the opposite direction along the second (gas heating) section, said envelope being provided with means for enlargement of the heat transfer surface facing the gas and of the distance the gas flows in contact with the envelope.

First vessel chamber may have a penetration for letting breathing gas be heated, into said first section for passage along same to the inlet of the second section.

Preferably the apparatus is designed in such a fashion that the pressure vessel is cylindrical, that the heating element is a cylindrical cartridge which is inserted with tight fit into a gilled pipe having an external helical flange, that the gilled pipe is surrounded by a mantle plate, which adjoins or lies adjacent to the flange tops, that an annular gap is arranged between the pressure vessel and the mantle plate substantially along the entire length of the mantle plate in order to define said first channel section, that the pressure vessel comprises an end cap having a first nozzle for leading cold breathing gas into the pressure vessel and to the annular gap, that a hood is connected to the end of the mantle plate located adjacent to the end cap, that a second nozzle is connected to the hood and extends through the end cap, that the partition is tightly connected both to the inside of the pressure vessel and to the tube core of the gilled pipe, that the gap is arranged to communicate with said second channel section adjacent the mantle plate end opposite the end cap, and that the tube core is sealed at the pipe end adjacent the hood.

Preferably the pressure vessel has a demountable end plate, and in that case a third nozzle is connected to the pressure vessel between the partition wall and the end plate, said third nozzle forming a sealed penetration for said current feed cable to the cartridge. Releasable locking means may be arranged at the tube core at the end thereof adjacent the partition wall, in order to formlock the cartridge in the gilled pipe. The end of the cartridge facing the hood is preferably arranged to be located at an axial distance from the adjacent end of the gilled pipe whereby the adjacent gilled pipe end extends axially beyond said cartridge end.

A transformator and/or current control equipment may be arranged in said second chamber.

The gas flowing in the first channel section will constitute a heat insulator between the relatively hot core of the apparatus and the water cooled pressure vessel. Thereafter the gas will pass into the second channel section and a flow in a helical path defined by the flanges of the gilled pipe and the mantle. There need not be any close fitting between the flanges and the mantle. Heat is transferred from the cartridge through the gilled pipe and to the breathing gas flowing in said second channel section. The heat absorbed by the breathing gas may to some extent be lost through the mantle, but heat is there absorbed by the gas flowing in the first channel section.

The first chamber of the pressure vessel is preferably entirely separated from the cartridge. At a possible malfunction of the heating cartridge, which normally is filled with a pulverous insulating material, material from the cartridge cannot pollute the breathing gas. If an electrical malfunction should occur, it cannot affect the breathing gas. If the cartridge would be in direct contact with the gas channel a serious situation could otherwise occur especially in view of the fact that the breathing gas often has an increased oxygen content. Moreover, due to the preferred embodiment of the apparatus, the heating cartridge can easily be removed and replaced should it fail.

In a preferred embodiment the gilled pipe is made of a tubular core of stainless steel having a helical gill of aluminium applied onto the tube core. The flange is then designed with a flange thickness of about 0.5 mm, the pitch of the helical flange being 7 revolutions per inch. The width of the flange is about 15 mm. Such gilled tubes are commercially available.

In the following the invention will be closer described in the form of an example with reference to the appended drawing.

DRAWING

The enclosed drawing shows schematically an axial section through an inventive apparatus.

PREFERRED EMBODIMENT OF THE INVENTION

On the drawing there is shown a pressure vessel consisting of a cylindrical vessel wall 5, which at the top is provided with an end cap 6 and the bottom is provided with an end plate 15, which is connected by means of bolts 16. In the pressure vessel a partition wall 10 is welded partly to the vessel wall 5, partly to a tube core 11 of a gilled pipe, which generally is denoted 2. The gilled pipe 2 substantially extends throughout the space between the end cap 6 and the wall 10.

The gilled pipe 2 has a helical flange 3. A mantle plate 4 surrounds the flange 3. The plate 4 has apertures 13 at the end thereof adjacent the partition wall 10. The plate 4 is at the top end thereof provided with a hood 8, which has a nozzle 9 that extends through the end cap 6. The end cap 6 has, moreover, a nozzle 7 for admission of cold air into the interior of the pressure vessel.

The tube core 11 is at the top end thereof closed by means of a welded end plate 14. A spacer block 27 is inserted into the tube core 11 to form a positioning piece for an electrical heating cartridge 1, inserted into the tube core, whereby the flange 3 extends axially beyond the cartridge end.

An annular gap 12 is arranged between the vessel wall 5 and the mantle plate 4 along substantially the entire length of the gilled pipe 2.

A releasable locking means 20, for example in the shape of a tubular screw which cooperates with an inner thread in the tube core 11, is arranged to maintain the cartridge in the tube core 11. The feed lines to the cartridge are illustrated at 21. The lines 21 are by means of a not shown connector in the space 19 between the partition wall 10 and the end piece plate 15, connectable to a power feed cable (not shown). A nozzle 17 extends through the vessel wall to the space 19. The nozzle 17 is provided with clamping means, penetration seals etc, indicated at 18.

When a malfunctioning cartridge 1 is to be exchanged, the screws 16 are released and the end plate 15 is removed. Thereafter the cable can be disconnected from the lines 21. Then, the screw 20 can be removed and the cartridge 1 axially be removed to be replaced by a new cartridge without any need to open the vessel space through which gas is flowing.

The heating cartridge may have an effect of about 600 W and hereby provide a gas temperature of about 100° C. Experience has shown that such high temperatures do not provide any discomfort for the diver, as the breathing air or breathing gas has very low moisture content. Such a relatively high temperature offers useful heat supply to the diver whereby the diver will not be subjected to any work capacity reduction or discomfort from the low ambient temperature defined by cold water. A further advantage of heating the gas (air) up to so relatively high temperature is that part of the heated gas flow can be diverted to the interior of a so called dry diver dress, whereby sweat from the diver will be absorbed by the heated breathing gas and then easily can be discharged from the dress simply by letting out such moisture laden gas. A further advantage of heating the gas to a high temperature is that malfunction of the pressure control valve and gas feed out valve due to ice formation, which otherwise could develop at work in cold water, is avoided. A specific advantage of the inventive apparatus is that it permits production of highly efficient heat transfer devices by means of simple commercially available machine element, and thanks to the helical flow path for the gas, the apparatus offers an advantageous heat transfer to the breathing gas. By letting the flange tube extend axially beyond the cartridge end, the advantage is won that the protruding flange portion which is not directly heated by the cartridge, prevents superheating of the cartridge portion processed to the hood 8. The cartridge temperature rises toward the outlet end of the second channel section. The heat supply is uniform along the cartridge, furthermore, the transfer resistance is also constant along the cartridge wherefore the temperature must rise in order that the cartridge shall be able to transfer the same heat amount in adjacent similar length portions of the cartridge. By displacing the cartridge somewhat from the upper end of the flange tube, the heat transfer surface of the cartridge portion adjacent the hood 8 is enlarged. Thereby, the temperature of said cartridge part will drop at the same transferred amount of heat and the same gas temperature. Of course the same result would be achievable by manufacturing the cartridge with a heat production which varies along the axial direction of the cartridge in such a way that the heat output is at the highest where the gas is coldest, and vice versa. However, this would mean a complicated manufacture of a special heating cartridge.

We claim:

1. In an apparatus for heating breathing gas for divers, comprising an electrical heating element which is arranged to transfer heat to the breathing gas in a gas channel in a breathing gas equipment adapted to be carried by the diver by heat transfer through the wall of the gas channel, the improvement comprising a pressure vessel which is divided by a partition into a first gas tight chamber in which the gas channel is located, the channel surrounding the element, and a second chamber which is openable and arranged to house connection equipment for connecting a feed cable which extends from a current source located above the water surface to the heating element, said gas channel comprising two coaxial sections, the first section being defined by the inner wall of the pressure vessel and a mantle coaxial to said wall, and the other section being defined by the mantle and an envelope surrounding the element, the breathing gas being arranged to flow in the axial direction along at least part of the first section, and then to flow in the opposite direction along the second section said envelope being provided with means for enlarging both the heat transfer surface facing the gas and the distance the gas flows in contact with the envelope, the first vessel chamber having a penetration for permitting breathing gas to be heated to flow into said first section for passage along the first section to the inlet of the second section, the pressure vessel being cylindrical, the heating element being a cylindrical cartridge which is inserted with tight fit into a gilled pipe having an external helical flange, the gilled pipe being surrounded by the mantle plate which adjoins or lies adjacent to the flange tops, an annular gap being arranged between the pressure vessel and the mantle plate substantially along the entire length of the mantle plate in order to define said first channel section, the pressure vessel including an end cap having the penetration in the form of a first nozzle for leading cold breathing gas into the pressure vessel and to the annular gap, a hood being connected to the end of the mantle plate located adjacent to the end cap, a second nozzle being connected to the hood and extending through the end cap, an annular partition being tightly connected both to the inside of the pressure vessel and to a tube core of the gilled pipe, the gap being arranged to communicate with said second channel section adjacent the mantle plate end opposite the end cap, and the tube core being sealed at the pipe end adjacent the hood.

2. Apparatus according to claim 1, wherein the pressure vessel has a demountable end plate, a third nozzle being connected to the pressure vessel between the annular partition and the end plate, said third nozzle forming a sealable penetration for said current feed cable to the cartridge.

3. Apparatus according to claim 1, further comprising releasable locking means arranged at the tube core at the end thereof adjacent the partition to formlock the cartridge in the gilled pipe.

4. Apparatus according to claim 1, wherein the end of the cartridge facing the hood is arranged to be located at an axial distance from the adjacent end of the gilled pipe whereby the adjacent gilled pipe end extends axially beyond said cartridge end.

* * * * *